US007207894B2

(12) United States Patent
Pine

(10) Patent No.: US 7,207,894 B2
(45) Date of Patent: Apr. 24, 2007

(54) GOLF CLUB GRIPPING AID AND METHOD OF USE THEREOF

(76) Inventor: Marmon Pine, 1795 Cardinal Ct., Wheeling, IL (US) 60090

( * ) Notice: Subject to any disclaimer, the term of this patent is extended or adjusted under 35 U.S.C. 154(b) by 0 days.

(21) Appl. No.: 11/270,290

(22) Filed: Nov. 9, 2005

(65) Prior Publication Data

US 2006/0105851 A1 May 18, 2006

Related U.S. Application Data

(60) Provisional application No. 60/627,253, filed on Nov. 12, 2004.

(51) Int. Cl.
*A63B 69/36* (2006.01)

(52) U.S. Cl. ..... 473/201; 473/205; 473/212; 473/294; 473/409

(58) Field of Classification Search ..... 473/201, 473/205, 206, 207, 212, 213, 294, 300, 301, 473/302, 303, 409
See application file for complete search history.

(56) References Cited

U.S. PATENT DOCUMENTS 1,483,595 A * 2/1924 Read ..... 473/205
1,567,658 A * 12/1925 Latina ..... 2/19
2,554,991 A * 5/1951 Kramer ..... 2/159
2,895,139 A * 7/1959 Compton ..... 2/161.8
3,508,280 A * 4/1970 Osborn ..... 2/159
4,000,903 A 1/1977 Swanson ..... 273/166
4,665,565 A * 5/1987 Odom ..... 2/161.2
4,858,246 A 8/1989 Wiggins ..... 2/161
5,028,050 A 7/1991 Freyer ..... 273/183
5,058,209 A * 10/1991 Eisenberg ..... 2/161.1
5,088,122 A 2/1992 O'Toole ..... 2/161
5,167,416 A * 12/1992 Painter ..... 473/204
5,253,367 A 10/1993 Lappley ..... 2/161.3
5,462,280 A 10/1995 Dickerson ..... 273/187.2
5,621,918 A 4/1997 Bernhard ..... 2/161.2
6,732,377 B1 * 5/2004 Wilkinson ..... 2/161.4
6,887,212 B2 * 5/2005 Bennett ..... 602/20

* cited by examiner

*Primary Examiner*—Nini F. Legesse
(74) *Attorney, Agent, or Firm*—Valauskas & Pine LLC

(57) ABSTRACT

A golf grip, device and method are described to hold a golf club shaft in a manner to avoid pinching the golf club shaft between the fingers and the thumb of the dominant hand. A device of the present invention, in one form, is a golf glove which includes a joining mechanism to affix the thumb and index finger of the dominant hand. The glove of the present invention is used in training and actual play to provide an improved grip which encourages a proper swing of the club.

7 Claims, 6 Drawing Sheets

FIG. 1A (prior art)
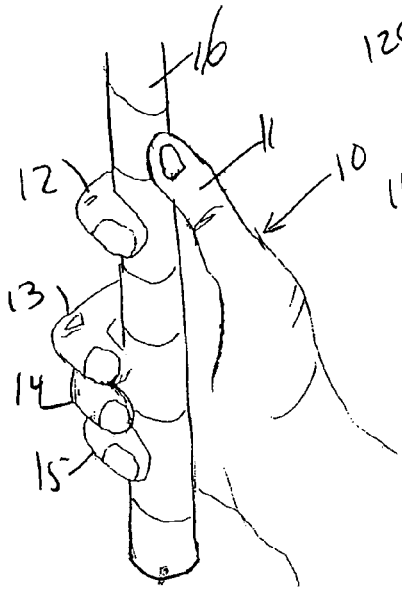
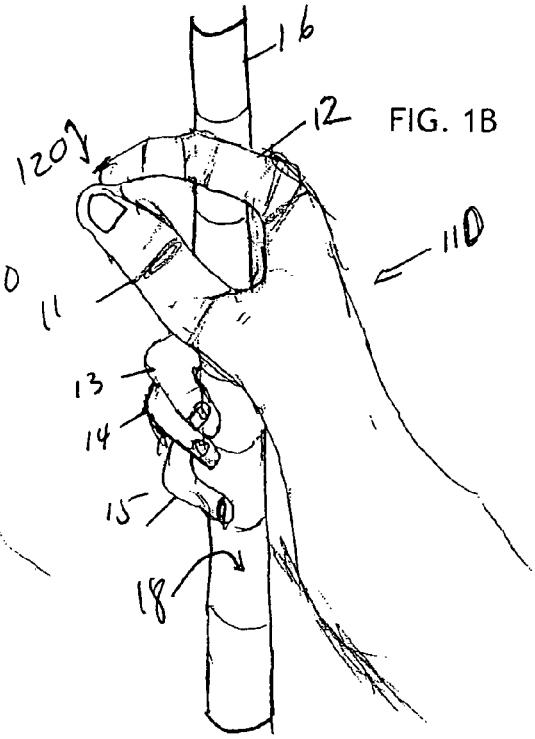
FIG. 1B
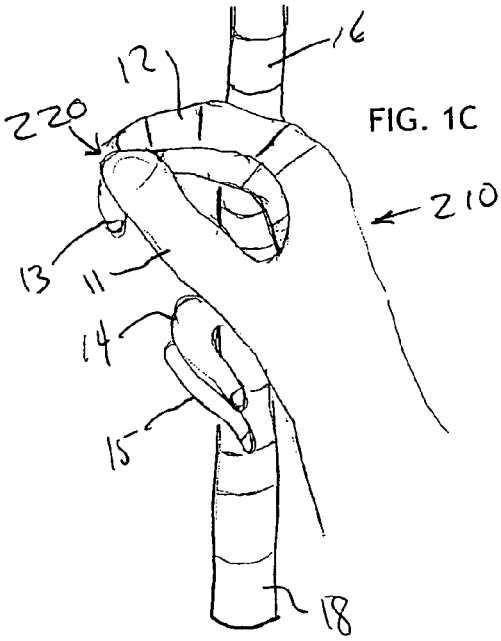
FIG. 1C
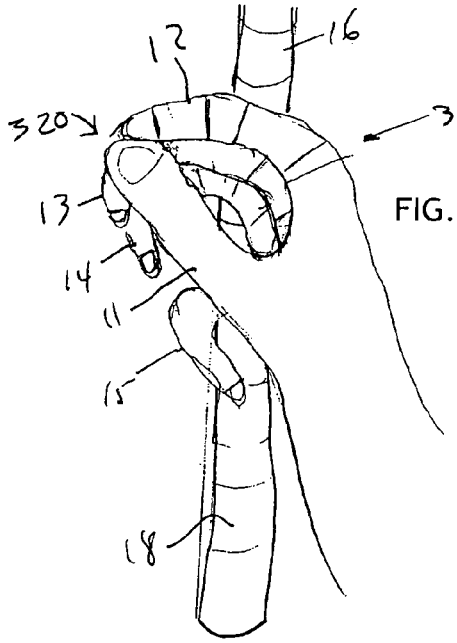
FIG. 1D

GOLF CLUB GRIPPING AID AND METHOD OF USE THEREOF

CONTINUING APPLICATION (PRIOR APPLICATION NOT ABANDONED)

Regular Filing of Provisional Application Ser. No. 60/627,253 filed on Nov. 12, 2004.

FIELD OF THE INVENTION

The present invention relates to a novel method of gripping a golf club and devices to assist a golfer to learn and use the new grip method to improve his golf club swing skills.

BACKGROUND OF THE INVENTION

This invention relates generally to a method and device for improving the mechanics of the golf swing of a golf player or golfer. It is a well-known objective of a desired golf swing to "square" the face of the golf club at the moment of impact with the golf ball. Essentially, "squaring" means that the face of the club is perpendicular to, and traveling in a direction directly lined up with the intended initial flight path of the ball. It is also well known to golfers that holding the golf club properly (i.e., using an effective golf "grip") is a major factor in effecting such a desired golf swing.

Although a player is certainly free to grip a golf club in any personal fashion, statistically, three gripping techniques, the "overlapping" grip, the "interlocking" grip and the "baseball" grip dominate the golfing world. (The exception to this statistic is "putting" wherein players tend to grip a selected putting club in multi-varied, personal and occasionally unique fashions). The overlapping grip and the interlocking grip are variations of the baseball grip.

All three grips start with the player seizing the golf club in a manner somewhat similar to the way in which the player would seize a baseball bat by wrapping the fingers of each hand around the grip and wrapping the thumbs in an opposite direction of the respective fingers on each hand. Then, in the case of the baseball grip, the player slides both hands together in a stacked fashion and prepares to swing.

In the case of the overlapping grip, the player seizes the golf club in a manner somewhat similar to the way in which the player would seize a baseball bat and slides both hands together. Then the player nestles (overlaps) the fourth or little finger of the trailing hand (that hand farthest away from the ball flight during the swing take-away—also referred to as the "dominant" or "strong" hand) within a groove which is formed between the index or forefinger and the adjacent or middle finger of the leading hand (that hand closest to the ball flight during the swing take-away, also referred to as the "weak" hand). In the case of the interlocking grip, the player seizes the golf club in a manner somewhat similar to the manner in which the player would seize a baseball bat and slides both hands together. Then the player intertwines (interlocks) the little finger of the trailing hand with the forefinger of the leading hand.

In all three grips, the shaft of the club passes between the thumb and forefinger (index finger) of each hand, enabling the player to grip the club shaft between the thumb and forefinger; a very strong grip. This results in or encourages a kind of "pinching force" between the parts of the thumb and parts of the forefinger.

These three grip techniques, with the resulting pinching force between thumb and forefinger, allow the player some control of hands, arms and body so as to transmit a variable amount of power to the golf swing while providing control over the speed and positioning of the golf club.

However, to the extent that the player fails to properly control the pinching force and also fails to control any or all of hands, arms and body, the golf club can be affected by at least one of three types of undesirable movements (lateral, vertical, rotational). Each of these undesirable movements, or combination of movements, negatively affects the ability of the player to square the clubface at the moment of impact with the golf ball and result in undesirable effects on ball flight. Such undesirable effects will vary, depending on which of the many available types of golf clubs (driver, iron, and putter) is being used. This is evidenced by the fact that golf instructors work continuously to help players learn to control factors affecting the golf swing. Much instruction is focused on the impact of the hands on the swing; in particular, the impact of the above described pinching effect in causing an imbalance of swing power between the dominant hand and the weak hand.

Right-handed players, using any of the three grip types described above, tend to dominate the swing with the right hand (similarly, left-handed players dominate with the left hand). As a result, for right-handed players, the right hand has become known as the "dominant" hand, the left hand usually referred to as the "weak" hand.

The following discussion is from the point of view of a right-handed player. In a like manner, wherever the personal pronoun "he" and the possessive pronoun "his" is used, it is understood to include female golfers.

In a common technique for teaching, learning or employing a correct swing, much attention is focused on reducing the impact of the dominant hand. For example, when the golfer is swinging a driver, over-powering the swing at impact by the dominant hand can result in a club rotational motion producing a severe left-to-right trajectory ("slice") or a right-to-left trajectory ("hook"). Similarly, were the same player to over-power a putting club with the dominant hand, the result might be a "yank", the ball pulling solidly left of the intended trajectory.

The importance of this dominant hand over-powering effect cannot be overstated. In fact, the professional golfer, Ben Hogan, referring to the importance of the grip on the desired swing, writes, "this means, in effect, subduing the natural tendency of the right forefinger and thumb to take charge. If they do, they'll ruin you." (*The Modern Fundamentals of Golf,* 1957) Similarly, the golf instructor, Manuel De La Torre, writes, "Hand action in the forward swing is the cause of more than 90% of all missed shots." (*Understanding the GolfSwing,* 2001)

Professional golfers have mastered the control of the dominant hand with respect to the weak hand during the golf swing. The non-professional "week-end" golfer seldom achieves this control. The typical result of a "dominant hand" swing for such a golfer is the dreaded "slice" (a serious left-to-right ball flight usually landing in a wooded area, a pond or out of bounds). In connection with this knowledge, numerous devices and methods have been adopted, and many patents obtained, on devices and methods for improving golf grips and golf swings. Examples of such known devices and methods are set forth in the following U.S. and international patents:

U.S. Pat. No. 5,064,198 issued on Nov. 12, 1991 to Gerald S. Szabo, discloses a putting aid wherein a strap is wrapped around the middle finger of the trailing (dominant) hand and attached to a wristband in order to prevent rotation of the wrist during the putting stroke.

U.S. Pat. No. 5,332,211 issued on Jul. 26, 1994 to Guerin D. Rife, et al., discloses a machine to enable a golfer to improve putting skills and at the same time become more aware of the optimum motion of shoulders and arms.

U.S. Pat. No. 5,704,845 issued to Wayne S. Boyte on Jan. 6, 1998 discloses a golf club teaching and gripping device for properly gripping a golf club without the risk of slipping.

U.S. Pat. No. 4,146,935 issued to Eddie Boyd Hinton discloses a glove for particular use in golf wherein, by the use of restrictive elastic bands fastened to the backside of the glove, the glove so hobbles the dominant hand as to reduce its gripping power.

While these devices may fulfill their respective, particular objective and requirements to an extent, the aforementioned patents fail to eliminate the actual source of the aforementioned undesirable swing effects. This source is believed to be the pinching force exerted on the golf club shaft as a result of the positioning of the golf club shaft between the thumb and forefinger of the dominant hand, a positioning which occurs when any of the three above described grips (baseball, overlap, and interlock) is employed. Because all three grips position the club shaft between the thumb and the forefinger of the dominant hand, any twist, twitch or turn of the dominant hand is amplified and transmitted directly to the club, creating the very same undesirable swing motions which the player is trying to eliminate.

A need exists for an improved method for gripping a golf club, one that eliminates the cause of these undesirable swing motions. A need exists for a device to aid or train a player to use such a method. The present device and method satisfies the need.

SUMMARY OF THE INVENTION

A device is described which has all the advantages of the prior art and none of the disadvantages, whereby a golfer may employ the device of the present invention to improve golfer's ability to swing the golf club in a desired swing path with desirable swing elements. A method is described which has all the advantages of the prior art and none of the disadvantages, whereby a golfer, by employing the method of the present invention during swinging the golf club, may improve a golfer's ability to swing the golf club in a desired swing path with desirable swing elements. Additionally, a method is described which has all the advantages of the prior art and none of the disadvantages, whereby an instructor may teach a golfer to improve golfer's ability to swing the golf club in a desired swing path with desirable swing elements.

In a preferred embodiment of the present invention the device takes form in a golfing glove to be worn on the dominant hand. A glove according to the present invention binds the tip of the golfer's thumb to the tip of the golfer's forefinger, forming a finger-group, similar to that which would occur if the golfer were to form the letter "o" with a thumb and forefinger or touch the ends of the thumb and forefinger together.

In use, the golfer dons the glove of the present invention, forming the above-described (two digit) finger-group. The golfer then seizes the golf club, placing the shaft of the club between the forefinger and the middle finger of the dominant hand. In this position, the finger-group is positioned comfortably on the topside of the shaft (the side facing the golfer) and the remaining fingers encircle the shaft on the bottom side (the side away from the golfer). Since the golfer's thumb and forefinger are both on the top side of the shaft, the deleterious pinching force on the shaft, described above between the forefinger and the thumb, is eliminated, thereby eliminating the imbalance of swing forces generated by the dominant hand as compared to the weak hand.

An alternative embodiment of a device according to the present invention takes the form of a golfing glove to be worn on the dominant hand. An aspect of the glove binds the tip of the golfer's thumb to the tip of the forefinger and to the tip of the middle finger, forming a finger-group of the dominant hand, similar to that which would occur if the golfer were to form the letter "o" with the thumb, forefinger and middle finger of the same hand or if the golfer were to touch the ends of the thumb, forefinger and middle finger together.

In use, the golfer dons the glove of the present invention, forming the above-described (three digit) finger-group. The golfer then grasps the golf club, placing the shaft of the club between the middle finger and the third finger. In this position, the finger-group is positioned comfortably on the topside of the shaft (the side facing the golfer) and the remaining fingers encircle the shaft on the bottom side (the side away from the golfer). Since the golfer's thumb and forefinger are both on the top side of the shaft, the deleterious pinching force on the shaft, described above, is eliminated, thereby eliminating the imbalance of swing forces generated by the dominant hand as compared to the weak hand.

Yet another alternative embodiment of the device of the present invention is in the form of a golfing glove to be worn on the dominant hand. The glove of the present invention binds the tip of the golfer's thumb to the tip of the forefinger and to the tip of the golfer's middle finger and to the tip of the third finger, forming a four digit finger-group, similar to that which would occur if the golfer were to form the letter "o" with thumb, forefinger, middle finger and ring finger or touch all four ends of the digits together.

In use, the golfer dons the glove of the present invention, forming the above-described four digit finger-group. Golfer then seizes the golf club, placing the shaft of the club between the third finger and the little finger. In this position, the finger-group is positioned comfortably on the topside of the shaft (the side facing the golfer) and the remaining finger encircles the shaft on the bottom side (the side away from the golfer). Since golfer's thumb and golfer's forefinger are both on the top side of the shaft, the deleterious pinching force on the shaft, described above, is eliminated, thereby eliminating the imbalance of swing forces generated by the dominant hand as compared to the weak hand.

An alternative embodiment of the device of the present invention is in the form of a sheath pair, comprising two sheath elements. A first sheath element captures at least the tip of golfer's dominant thumb, and may also capture all or part of the remainder of golfer's dominant thumb. A second sheath element captures at least the tip of golfer's dominant forefinger, and may also capture all or part of the remainder of golfer's dominant forefinger. The first and second sheath of the present invention bind the tip of golfer's thumb to the tip of golfer's forefinger, forming a finger-group, similar to that which would occur if the golfer were to form the letter "o" with golfer's thumb and forefinger.

In use, the golfer dons the sheath pair of the present invention, forming the above-described two digit finger-group. The golfer then seizes the golf club, placing the shaft of the club between the forefinger and the middle finger. In this position, the finger-group is positioned comfortably on the topside of the shaft (the side facing the golfer) and the remaining fingers encircle the shaft on the bottom side (the side away from the golfer). Since golfer's thumb and golfer's forefinger are both on the top side of the shaft, the deleterious pinching force on the shaft, described above, is eliminated, thereby eliminating the imbalance of swing forces generated by the dominant hand as compared to the weak hand.

It is an object of the present invention to provide a method of gripping a golf club whereby a golfer can improve the golf swing.

It is another object of the present invention to provide a device to aid a golfer to improve the golf swing.

It is another object of the present invention to provide a device to aid a golfer to improve the golf swing, which device can be used by a golfer at any swing during any golf round.

It is another object of the present invention to provide a device to aid a golfer to improve the golf swing, which device can be used with all existing golf clubs without the need to modify any club in any manner.

It is another object of the present invention to provide a device to aid a golfer to improve the golf swing, which device is inexpensive to manufacture and sufficiently easy to use that it can be used by adults and children alike with a minimum of instruction.

It is another object of the present invention to provide a training device for teaching a golfer how to improve the golf swing.

It is another object of the present invention to provide a training device for teaching a golfer how to improve the golf swing, which said device can be used by a golfer at any swing during any golf round.

It is another object of the present invention to provide a training device for teaching a golfer how to improve the golf swing, which said device could be used with all existing golf clubs without the need to modify any club in any manner.

It is another object of the present invention to provide a training device which can be used by a golfer to improve the golf swing which device is inexpensive to manufacture and sufficiently easy to use that it can be used by adults and children alike with a minimum of instruction.

It is another object of the present invention to provide a method of using a device to teach a golfer how to improve the golf swing.

BRIEF DESCRIPTION OF THE DRAWINGS

FIG. 1A illustrates a prior art golf club gripping method.

FIG. 1B illustrates a golf club gripping method first according to a first preferred embodiment of the present invention.

FIGS. 1C & 1D each illustrate a golf club gripping method according to alternative embodiments of the present invention.

DETAILED DESCRIPTION OF EMBODIMENTS OF THE INVENTION

Figure 2A:
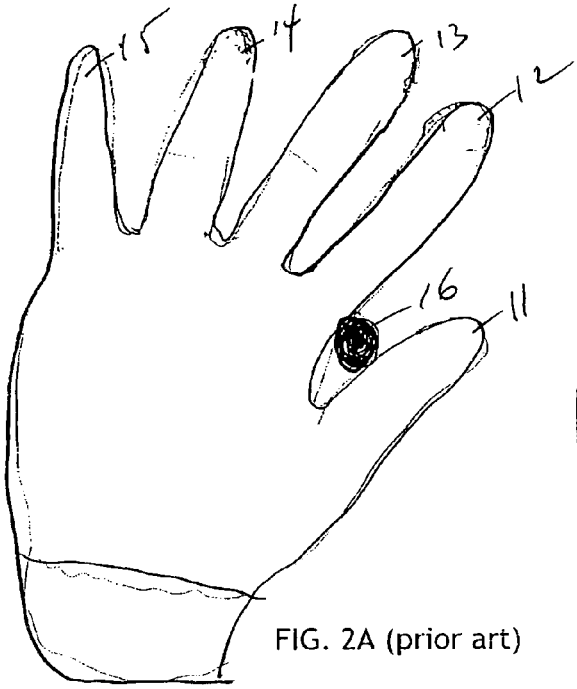
FIG. 2A (prior art)
FIG. 2A illustrates a prior art method for positioning a golf club shaft within a player's fingers.
Figure 2B:
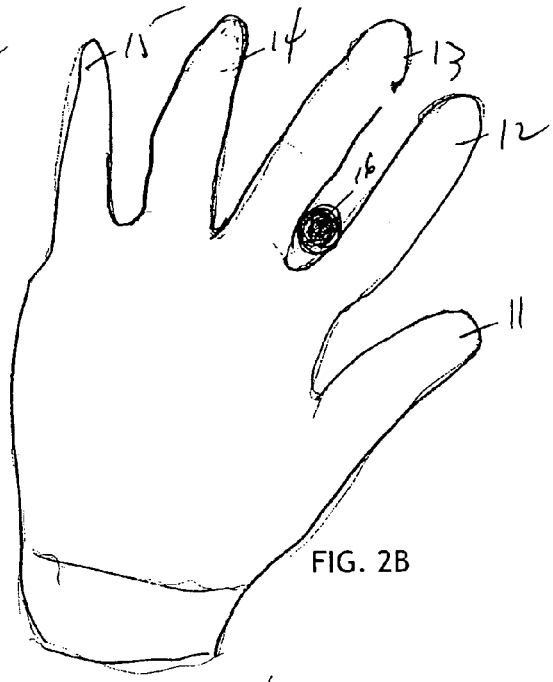
FIG. 2B illustrates a method of the present invention for positioning a golf club shaft within a golfer's fingers according to a preferred embodiment of the invention.

FIG. 1A depicts a prior art grip 10 or arrangement of the thumb 11 and the fingers, i.e., first finger or index 12, second finger or middle finger 13, third finger or ring finger 14, and fourth finger or little finger 15 of a golfer's hand, wherein a golf club shaft 16 is located such that thumb 10 and fingers 12–15 are positioned so as to be located on opposite sides of shaft 16. This results in a "pinching" force on shaft 16, trapped between finger 12 and thumb 10. Frequently, the left hand (not shown) is provided with a typical golf glove (not shown) covering most or all of the palm and fingers of the hand. Typically, the right hand is gripped bare about the club shaft after the left.

FIG. 1B illustrates a method of gripping a golf club shaft according to an embodiment of the present invention. The grip or arrangement 110 includes placement of the golfer's thumb 11 and fingers 12–15, wherein the shaft 16 of the golf club (not shown) is located such that thumb 11 and finger 12 are on the same side of shaft 16, i.e., an upper side 18 of shaft 16. Since the thumb 11 and index finger 12 are on the top 18 of the shaft 16, the shaft passes between the index finger 12 and the middle finger 13. The remaining fingers 14, 15 also grip the shaft 16 on the same side as the middle finger 13. This arrangement of fingers eliminates the "pinching" force produced with the grip shown in FIG. 1A. In FIG. 1B, the shaft 16 is positioned to extend between finger 12 and finger 13. In this inventive example, the thumb 11 and forefinger 12 form a two digit finger-group 120.

FIG. 1C illustrates an alternate arrangement of golfer's thumb 11 and fingers 12, 13, 14 and 15, wherein shaft 16 is located such that thumb 11, finger 12 and finger 13 are all on the same side (an upper side 18) of shaft 16, eliminating the "pinching" force of the prior art arrangement of FIG. 1A. Shaft 16 is positioned between a three digit finger-group 220 including thumb 11, and fingers 12, 13, which are positioned on the upper side 18 of shaft 16 and fingers 14, 15 which wrap around the shaft 16 to oppose the three digit finger-group.

FIG. 1D illustrates yet another alternate embodiment of the present invention arrangement of the golfer's thumb 11 and fingers 12, 13, 14 and 15. The shaft 16 is located such that thumb 11, finger 12, finger 13 and finger 14 are all on the same upper side 18 of shaft 16, eliminating the "pinching" force of the prior art arrangement of FIG. 1A. As seen in FIG. 1D, the shaft 16 is located between fingers 14 and 15. Finger-group 320 of thumb 11 and fingers 12–14 are grouped together above the shaft 16 while small finger 15 is wrapped under shaft 16.

In the illustrated examples of each of FIGS. 1A–1D, finger groups 120, 220 and 320, respectively, are wrapped counterclockwise as viewed from the top or free end of the golf club shaft 16. The remaining fingers, 13–15, 14–15 and 15, respectively, are wrapped clockwise.

Figure 2C:
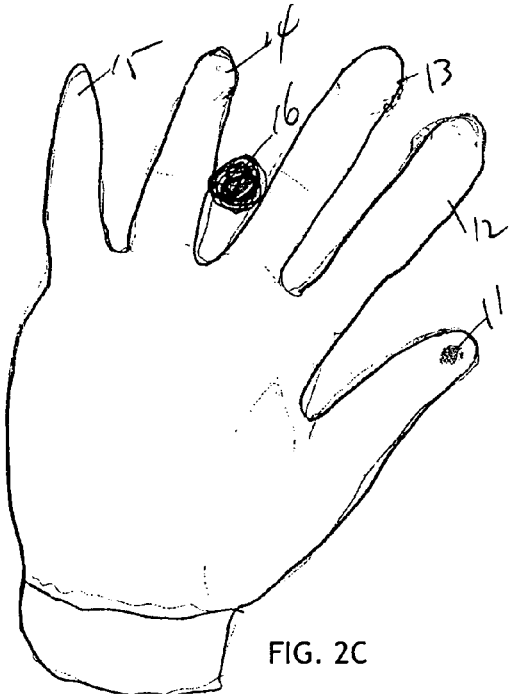
FIGS. 2C & 2D each illustrate a method according to alternative embodiments of the present invention for positioning a golf club shaft within a golfer's fingers.
Figure 2D:
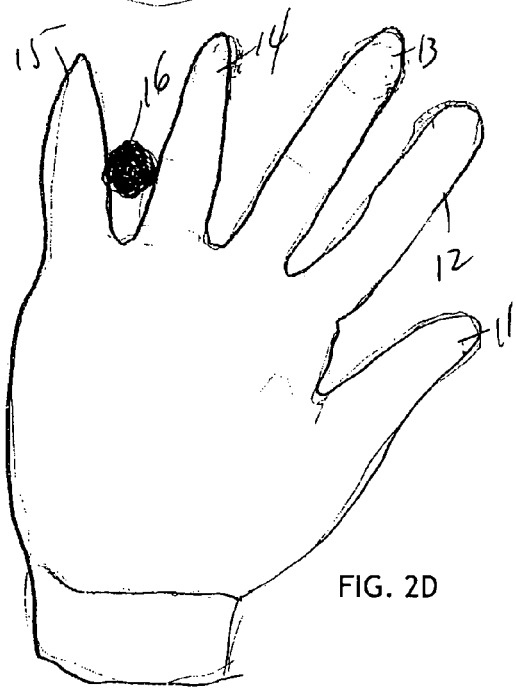

The position of the shaft 16 in each of FIGS. 1A–1D is shown in FIGS. 2A–2D respectively. In FIG. 2A, a palm-upward view seen prior to closing the hand around the golf club shaft 16, the shaft 16 is positioned between the thumb 11 on one side of the shaft, which thumb is wrapped a first direction and the fingers 12–15 are positioned in opposition to the thumb and wrapped the opposite direction With respect to FIGS. 2B–2D a number of fingers are grouped with the thumb. For example, in FIG. 2B, the index finger 12 is grouped on the same side as the thumb 11 as shown in FIG. 1B. In FIG. 2C, the index finger 12 and middle finger 13 is grouped on the same side as the thumb 11 as shown in FIG. 1C. In FIG. 2D, the index finger 12, middle finger 13 and ring finger 14 is grouped on the same side as the thumb 11 as shown in FIG. 1D.

Figure 3:
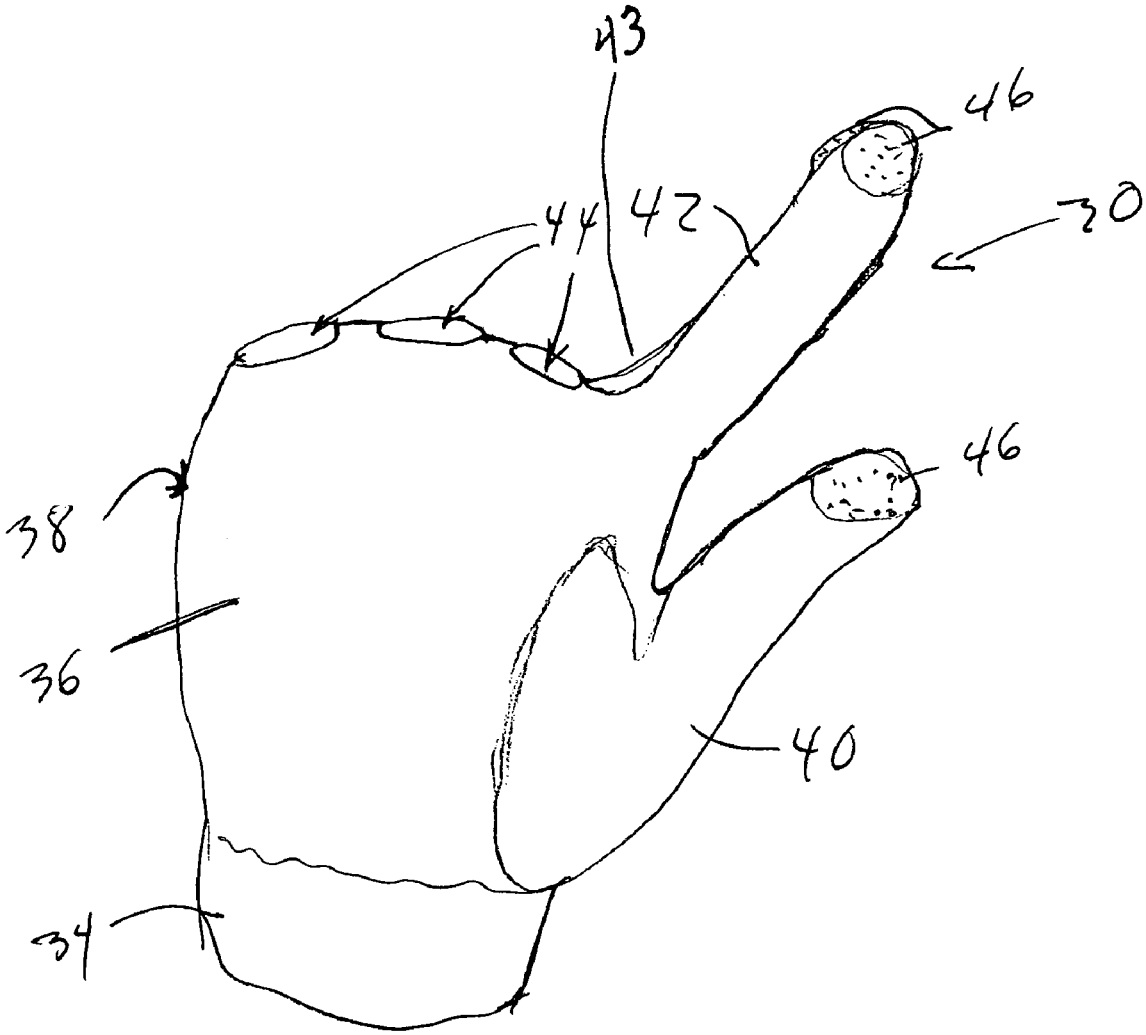
FIG. 3 is a palmar view of a glove according to one embodiment of the present invention.

Turning to FIG. 3, an embodiment of a device is illustrated which is in the form of a glove 30, is designed to be worn on the golfer's "dominant" hand, hereinafter, glove/hand (the right hand for a right handed golfer, the left hand for a left handed golfer). Glove 30, illustrated in a palm-up view, includes an annular wrist portion 34 sized and shaped to be fixed about the user's wrist. The glove 30 includes a palm panel 36, which roughly corresponds to the user's palm. The glove 30 includes a back panel 38, which roughly mirrors the palm panel 36. The glove 30 includes a thumb portion 40, which is sized and shaped to accommodate the insertion of a thumb of the user and is attached to a thumb side of the glove. The glove 30 also includes a first finger portion 42, sized and shaped to accommodate the insertion of an index finger of the user, which is attached to the glove adjacent the thumb portion 40. Three openings 44 are formed through the glove 30 adjacent the first finger portion 42 and approximately along a seam between the palm portion 36 and the back panel 38. The glove 30 may be made from any suitable material such as natural leather or synthetic leather, for example. The construction method may be any suitable or conventional assembly and manufacture method as by cutting and sewing, for example.

One important feature of the glove 30 is a joining portion 46 on each of the thumb portion 40 and the finger portion 42. The joining portion 46 functions to removably (or permanently) fix the thumb portion 40 and the finger portion 42 together. The joining portion 46 may be any suitable material and/or mechanism for joining the thumb portion 40 to the finger portion 42 together. For example, the joining portion may be an adhesive, a respective hook and loop material, a snap or the thumb and finger portions 40, 42 may be permanently joined as by sewing, for example.

Another important feature of glove 30 is a pad portion 43 located on finger portion 42 on the side opposite thumb portion 40 and at the location where finger portion 42 joins to palm portion 36 and back panel 38. The pad portion 43 functions to cushion forces applied to finger 12 or finger 13 by the golf club shaft 16 (see FIG. 2). Pad portion 43 may be constructed from any suitable cushioning material, such as wool, leather, foam and the like. Pad portion 43 may be removably (or permanently) attached to glove 30, either inside or outside, for example, by hook and loop material or by sewing or the like.

In use, the golfer dons the glove 30 and inserts a thumb 11 (see FIG. 1B) into thumb portion 40 and a finger 12 (see FIG. 1B) into the finger portion 42. The remaining fingers are fitted through openings 44. The palm portion 36 is, of course, positioned adjacent the user's palm and the back portion 38 is positioned adjacent the back of the user's hand. The thumb and finger portions 40, 42 are brought into contact and joined together into a finger-group before or after grasping a golf club. The wrist portion 34 may be clasped about the wrist of the user by a stretchable fabric or a hook and loop closure as is well known to retain the glove in place.

Figure 4:
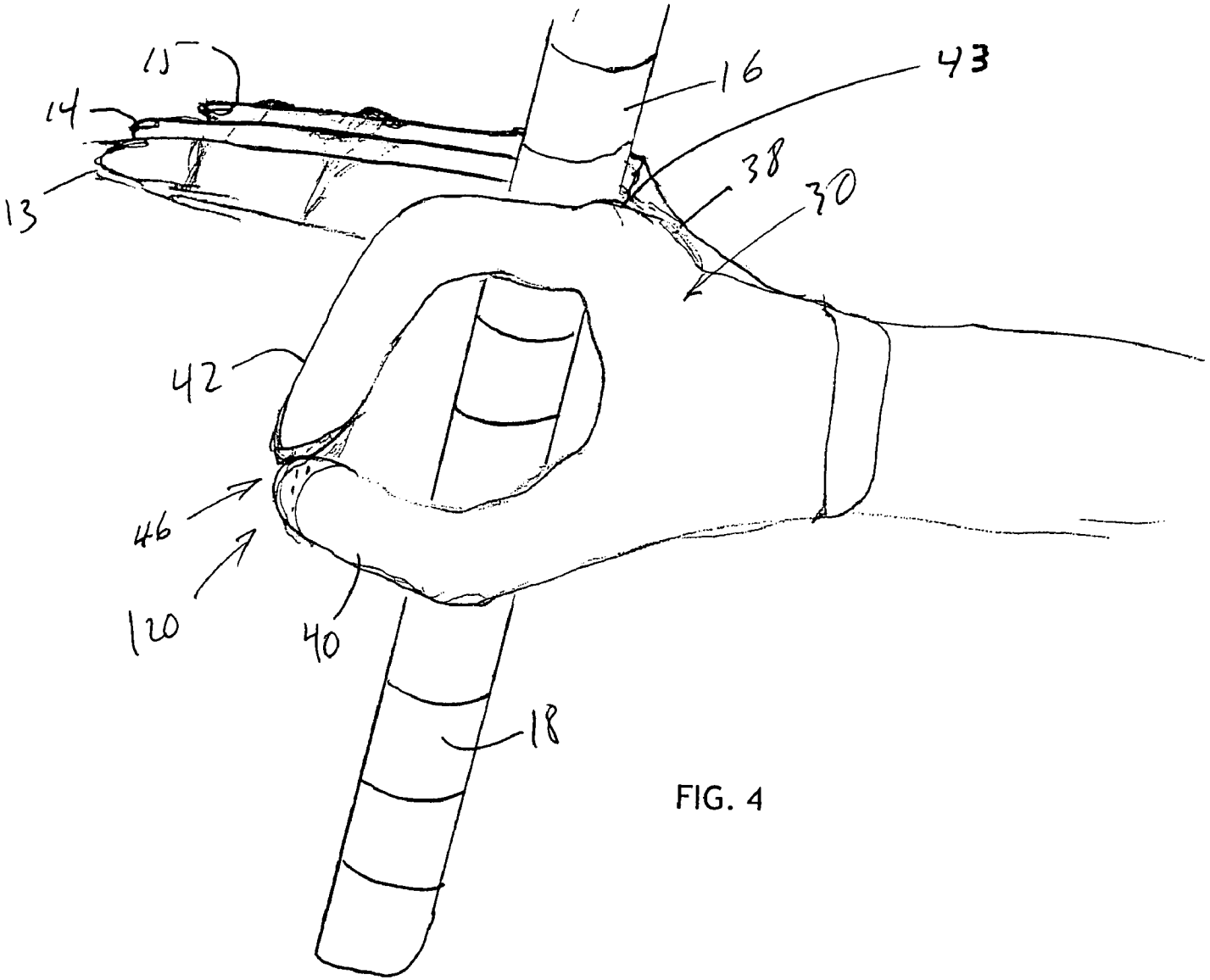
FIG. 4 illustrates a side view of golfer's hand wearing the glove of FIG. 3.

Referring to FIG. 4, after the glove is positioned on the user's hand, the shaft 16 of the golf club is positioned according to the grip of the present invention, namely wherein the shaft 16 is inserted between the middle finger 13 and the index finger 12, and wherein the shaft 16 rests against pad portion 43, and the tips of the finger portion 42 is attached to the thumb portion 40 of the glove to form a one finger group 120 atop the shaft 16 by affixing joining portions 46 together. The remaining fingers 12–15 are positioned below the shaft 16. After the grip is established with the shaft, the user may swing the club in a practice session, for example, while learning to swing, or at a driving range during practice. In the alternate, the glove and resulting grip may be used in competition during golf play at a golf course with the benefits set out above. Because the thumb and the forefinger are positioned on the same side of the golf club shaft, they cannot exert a "pinching effect" on the golf club shaft. Hence, no pinching force can be transmitted to the golf club during the swing, effectively removing from the swing many of the undesirable swing elements previously introduced by the dominant hand.

Figure 5:
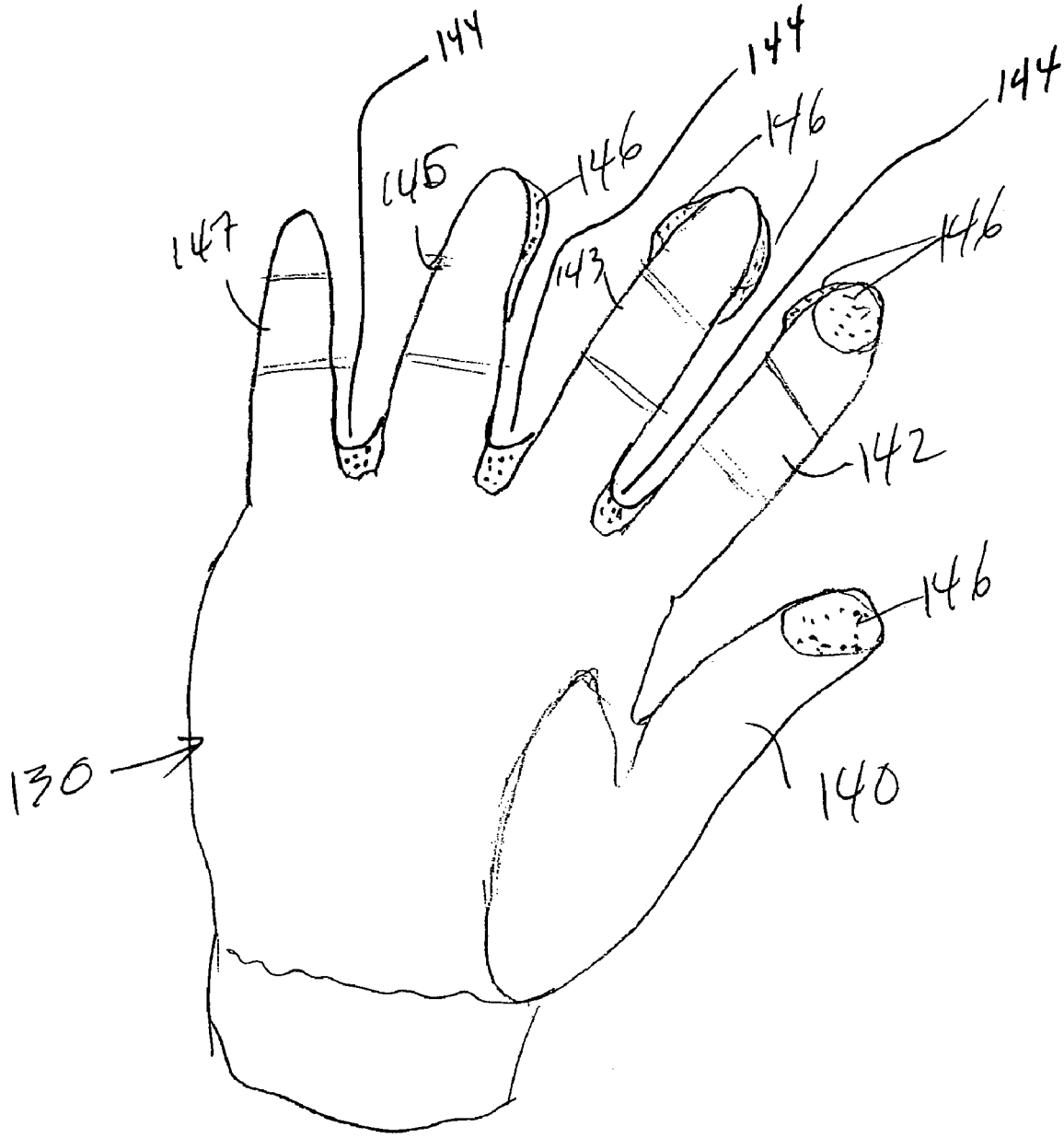
FIG. 5 illustrates an alternative embodiment of the glove of the present invention.

It will be understood that the glove of FIG. 4 may be modified so as to provide portions to accommodate some or all of the remaining fingers of the users hand and a joining portion 46 may be provided to the ends of each of the finger portion (see FIG. 5) to form finger groups 120, 220, 320 according to FIGS. 1B–1D. Thus, in FIG. 5, glove 130 includes a thumb portion 140 with a joining portion 146. First finger portion 142 includes a joining portion 146. Similarly, second finger portion 143, third finger portion 145 each includes a joining portion 146. Fourth finger portion 147 may be provided in a conventional form. Where desired, a pad portion 144 is located between each junction of fingers not used in the above described finger groups.

Figure 6:
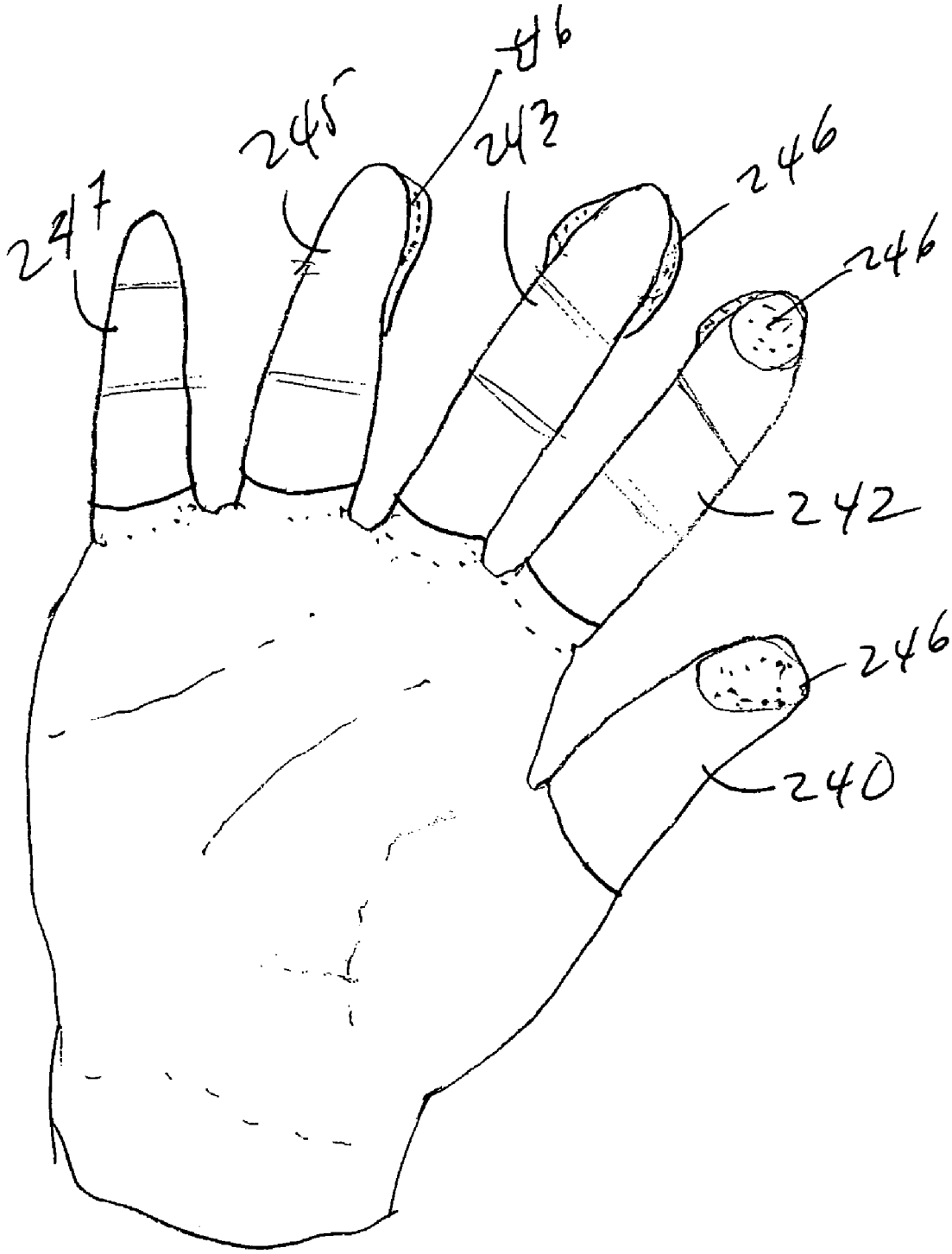
FIG. 6 illustrates a sheath-type alternative embodiment of the present invention.

In an alternate embodiment, sheaths 240, 242, 243, 245, and 247 may be provided, shown in FIG. 6, as opposed to a full-fingered glove, with a joining portion 246 as that provided to the previous glove-type embodiments of the present invention. Use of a sheath 247 on the little finger, of course is optional. When used, the sheaths 240–245 may capture any or all of player's dominant hand to form a finger-group atop the club shaft (not shown).

In use, the present invention may include the steps of donning and adjusting the glove of the present invention to form a finger-group as described above and gripping the golf club by placing the above described finger-group on the top side of the golf shaft and simultaneously placing player's dominant hand remaining non-joined fingers on the side of the golf club underneath the shaft, inserting the shaft of the golf club through the space formed between player's finger-group and player's nearest non-joined finger(s). Thus, a "pinching" action upon the golf club shaft between the thumb and fingers is avoided.

Thus, while the invention has been described herein with relation to certain embodiments and applications, those with skill in this art will recognize changes, modifications, alterations and the like which still come within the spirit of the inventive concept, and such are intended to be included within the scope of the invention as expressed in the following claims.

What is claimed is:

1. A method of teaching a reducing of a pinching force on a shaft of a golf club, the method comprising the steps of:

a. teaching a golfer to hold the shaft of said golf club with the golfer's weak hand;

b. teaching the golfer to hold the shaft of said golf club with said golfer's dominant hand, such that said weak hand is in closer proximity to said golfer than said dominant hand;

c. teaching the golfer to place said shaft of said golf club between a forefinger and a middle finger of said dominant hand thereby reducing the pinching force on the shaft of the golf club, comprising teaching the golfer to wear a golf glove on the dominant hand, said golf glove having (a) a thumb portion, said thumb portion having a thumb tip, (b) an index finger portion, said index finger portion having an index finger tip, and (c) a middle finger portion, said golf glove configured such that said thumb tip on said thumb portion is fastened to said index finger tip on said index finger portion, such that when said golfer wears the golf glove and grasps said golf club, said shaft of said golf club is located between the index finger portion and the middle finger portion of the dominant hand.

2. The method of teaching the reducing of a pinching force on the shaft of the golf club of claim 1, wherein said thumb tip on said thumb portion of said golf glove and said index finger tip on said index finger tip portion of said golf glove are securely fastened.

3. The method of teaching the reducing of a pinching force on the shaft of the golf club of claim 2, wherein said thumb tip on said thumb portion of said golf glove and said index finger tip on said index finger tip portion of said golf glove are securely fastened by being sewed together.

4. The method of teaching the reducing of a pinching force on the shaft of the golf club of claim 2, wherein said thumb tip on said thumb portion of said golf glove and said index finger tip on said index finger tip portion of said golf glove are securely fastened by adhesive.

5. The method of teaching the reducing of a pinching force on the shaft of the golf club of claim 1, wherein said thumb tip on said thumb portion of said golf glove and said index finger tip on said index finger tip portion of said golf glove are removably fastened.

6. The method of teaching the reducing of a pinching force on the shaft of the golf club of claim 5, wherein said thumb tip on said thumb portion of said golf glove and said index finger tip on said index finger tip portion of said golf glove are removably fastened by hook and loop fasteners.

7. The method of teaching the reducing of a pinching force on the shaft of the golf club of claim 5, wherein said thumb tip on said thumb portion of said golf glove and said index finger tip on said index finger tip portion of said golf glove are removably fastened by snaps.

* * * * *